US007398819B2

(12) United States Patent
Taras et al.

(10) Patent No.: US 7,398,819 B2
(45) Date of Patent: Jul. 15, 2008

(54) MINICHANNEL HEAT EXCHANGER WITH RESTRICTIVE INSERTS

(75) Inventors: Michael F. Taras, Fayetteville, NY (US); Allen C. Kirkwood, Danville, IN (US); Robert A. Chopko, Baldwinsville, NY (US); Mikhail B. Gorbounov, South Windsor, CT (US); Igor B. Vaisman, West Hartford, CT (US); Parmesh Verma, Manchester, CT (US)

(73) Assignee: Carrier Corporation, Farmington, CT (US)

( * ) Notice: Subject to any disclaimer, the term of this patent is extended or adjusted under 35 U.S.C. 154(b) by 589 days.

(21) Appl. No.: 10/987,972

(22) Filed: Nov. 12, 2004

(65) Prior Publication Data

US 2006/0102332 A1 May 18, 2006

(51) Int. Cl.
*F28D 1/00* (2006.01)

(52) U.S. Cl. ..... 165/150; 62/525; 62/527; 165/109.1; 165/174; 165/906; 165/910; 165/163; 165/164; 165/154; 165/177

(58) Field of Classification Search ..... 62/525, 62/527, 526; 165/109.1, 174, 906, 910, 150, 165/163, 164, 154, 177
See application file for complete search history.

(56) References Cited

U.S. PATENT DOCUMENTS

| | | | | |
|---|---|---|---|---|
| 2,097,602 A | | 11/1937 | Rohlin | |
| 2,688,986 A | * | 9/1954 | O'Brien | 138/38 |
| 2,691,991 A | * | 10/1954 | Schutt et al. | 138/38 |
| 3,692,064 A | * | 9/1972 | Hohnerlein et al. | 138/42 |
| 3,976,128 A | | 8/1976 | Patel et al. | |
| 4,261,177 A | | 4/1981 | Sterlini | |
| 4,277,953 A | | 7/1981 | Kramer | |
| 4,309,987 A | | 1/1982 | Higgins, Jr. | |

(Continued)

FOREIGN PATENT DOCUMENTS

| | | |
|---|---|---|
| GB | 2250336 | 6/1992 |

(Continued)

OTHER PUBLICATIONS

The American Heritage Dictionary of the English Language, Fourth Edition, Copyright 2000 by Houghton Mifflin Company, Published by Houghton Mifflin Company.*

*Primary Examiner*—Cheryl J. Tyler
*Assistant Examiner*—Emily Iris Nalven
(74) *Attorney, Agent, or Firm*—Marjama Muldoon Blasiak & Sullivan LLP

(57) ABSTRACT

A comb-like insert having a body and plurality of tapered fingers is installed with its fingers disposed within respective minichannels. The fingers and their respective minichannels are so sized as to restrict the channels and frictionally hold the insert in place in one dimension while providing for gaps in another dimension such that the flow of refrigerant is somewhat obstructed but allowed to pass through the gaps between the insert fingers and the minichannel walls and then expand as it passes along the tapered fingers to thereby provide a more homogenous mixture to the individual minichannels. A provision is also made to hold the insert in its installed position by way of internal structure within the inlet manifold. In one embodiment, an internal plate is provided for that purpose, and the plate has openings formed therein for the equalization of pressure on either side thereof.

17 Claims, 2 Drawing Sheets

U.S. PATENT DOCUMENTS

| | | | | |
|---|---|---|---|---|
| 4,382,468 | A | | 5/1983 | Hastwell |
| 4,524,823 | A | | 6/1985 | Hummel et al. |
| 4,593,539 | A | | 6/1986 | Humpolik et al. |
| 5,103,559 | A | | 4/1992 | Hoffmuller |
| 5,343,620 | A | | 9/1994 | Velluet |
| 5,523,607 | A | | 6/1996 | Zambrano |
| 5,651,268 | A | | 7/1997 | Aikawa et al. |
| 5,704,221 | A | | 1/1998 | Lego |
| 5,743,111 | A | | 4/1998 | Sasaki et al. |
| 5,765,393 | A | | 6/1998 | Shlak et al. |
| 5,806,586 | A | | 9/1998 | Osthues et al. |
| 5,881,456 | A | | 3/1999 | Bergins et al. |
| 5,901,785 | A | | 5/1999 | Chiba et al. |
| 5,931,220 | A | | 8/1999 | Ueda et al. |
| 5,941,303 | A | | 8/1999 | Gowan et al. |
| 6,053,243 | A | | 4/2000 | Kato et al. |
| 6,179,051 | B1 | | 1/2001 | Ayub |
| 6,286,590 | B1 | | 9/2001 | Park |
| 6,394,176 | B1 | | 5/2002 | Marsais |
| 6,430,945 | B1 | | 8/2002 | Haussmann |
| 6,470,703 | B2 | | 10/2002 | Wada et al. |
| 6,484,797 | B2 | | 11/2002 | Saito et al. |
| 6,688,137 | B1 | | 2/2004 | Gupte |
| 6,688,138 | B2 | | 2/2004 | DiFlora |
| 6,729,386 | B1 | | 5/2004 | Sather |
| 6,796,374 | B2 | | 9/2004 | Rong |
| 6,814,136 | B2 | | 11/2004 | Yi et al. |
| 6,988,539 | B2 | | 1/2006 | Kato et al. |
| 7,021,371 | B2 | | 4/2006 | Saito et al. |
| RE39,309 | E | * | 10/2006 | McNamara ..... 99/403 |
| 7,143,605 | B2 | | 12/2006 | Rohrer et al. |
| 2002/0174978 | A1 | | 11/2002 | Beddome et al. |
| 2003/0010483 | A1 | | 1/2003 | Ikezaki et al. |
| 2003/0116310 | A1 | | 6/2003 | Wittmann et al. |

FOREIGN PATENT DOCUMENTS

| | | |
|---|---|---|
| JP | 4295599 | 10/1992 |
| JP | 6159983 | 6/1994 |
| JP | 2001304775 | 10/2001 |
| WO | WO-9414021 | 6/1994 |

* cited by examiner

MINICHANNEL HEAT EXCHANGER WITH RESTRICTIVE INSERTS

BACKGROUND OF THE INVENTION

This invention relates generally to air conditioning and refrigeration systems and, more particularly, to parallel flow evaporators thereof.

A definition of a so-called parallel flow heat exchanger is widely used in the air conditioning and refrigeration industry now and designates a heat exchanger with a plurality of parallel passages, among which refrigerant is distributed and flown in the orientation generally substantially perpendicular to the refrigerant flow direction in the inlet and outlet manifolds. This definition is well adapted within the technical community and will be used throughout the text.

Refrigerant maldistribution in refrigerant system evaporators is a well-known phenomenon. It causes significant evaporator and overall system performance degradation over a wide range of operating conditions. Maldistribution of refrigerant may occur due to differences in flow impedances within evaporator channels, non-uniform airflow distribution over external heat transfer surfaces, improper heat exchanger orientation or poor manifold and distribution system design. Maldistribution is particularly pronounced in parallel flow evaporators due to their specific design with respect to refrigerant routing to each refrigerant circuit. Attempts to eliminate or reduce the effects of this phenomenon on the performance of parallel flow evaporators have been made with little or no success. The primary reasons for such failures have generally been related to complexity and inefficiency of the proposed technique or prohibitively high cost of the solution.

In recent years, parallel flow heat exchangers, and brazed aluminum heat exchangers in particular, have received much attention and interest, not just in the automotive field but also in the heating, ventilation, air conditioning and refrigeration (HVAC&R) industry. The primary reasons for the employment of the parallel flow technology are related to its superior performance, high degree of compactness and enhanced resistance to corrosion. Parallel flow heat exchangers are now utilized in both condenser and evaporator applications for multiple products and system designs and configurations. The evaporator applications, although promising greater benefits and rewards, are more challenging and problematic. Refrigerant maldistribution is one of the primary concerns and obstacles for the implementation of this technology in the evaporator applications.

As known, refrigerant maldistribution in parallel flow heat exchangers occurs because of unequal pressure drop inside the channels and in the inlet and outlet manifolds, as well as poor manifold and distribution system design. In the manifolds, the difference in length of refrigerant paths, phase separation and gravity are the primary factors responsible for maldistribution. Inside the heat exchanger channels, variations in the heat transfer rate, airflow distribution, manufacturing tolerances, and gravity are the dominant factors. Furthermore, the recent trend of the heat exchanger performance enhancement promoted miniaturization of its channels (so-called minichannels and microchannels), which in turn negatively impacted refrigerant distribution. Since it is extremely difficult to control all these factors, many of the previous attempts to manage refrigerant distribution, especially in parallel flow evaporators, have failed.

In the refrigerant systems utilizing parallel flow heat exchangers, the inlet and outlet manifolds or headers (these terms will be used interchangeably throughout the text) usually have a conventional cylindrical shape. When the two-phase flow enters the header, the vapor phase is usually separated from the liquid phase. Since both phases flow independently, refrigerant maldistribution tends to occur.

If the two-phase flow enters the inlet manifold at a relatively high velocity, the liquid phase (droplets of liquid) is carried by the momentum of the flow further away from the manifold entrance to the remote portion of the header. Hence, the channels closest to the manifold entrance receive predominantly the vapor phase and the channels remote from the manifold entrance receive mostly the liquid phase. If, on the other hand, the velocity of the two-phase flow entering the manifold is low, there is not enough momentum to carry the liquid phase along the header. As a result, the liquid phase enters the channels closest to the inlet and the vapor phase proceeds to the most remote ones. Also, the liquid and vapor phases in the inlet manifold can be separated by the gravity forces, causing similar maldistribution consequences. In either case, maldistribution phenomenon quickly surfaces and manifests itself in evaporator and overall system performance degradation.

In tube-and-fin type heat exchangers, it has been common practice to provide individual capillary tubes or other expansion devices leading to the respective tubes in order to get relatively uniform expansion of a refrigerant into the bank of tubes. Another approach has been to provide individual expansion devices such as so-called "dixie" cups at the entrance opening to the respective tubes, for the same purpose. Neither of these approaches are practical in minichannel or microchannel applications, wherein the channels are relatively small and closely spaced such that the individual restrictive devices could not, as a practical manner, be installed within the respective channels during the manufacturing process.

In the air conditioning and refrigeration industry, the terms "parallel flow" and "minichannel" (or "microchannel") are often used interchangeably in reference to the abovementioned heat exchangers, and we will follow similar practice. Furthermore, minichannel and microchannel heat exchangers differ only by a channel size (or so-called hydraulic diameter) and can equally benefit from the teachings of the invention. We will refer to the entire class of these heat exchangers (minichannel and microchannel) as minichannel heat exchangers throughout the text and claims.

SUMMARY OF THE INVENTION

Briefly, in accordance with one aspect of the invention, a comb-like insert having a body and a plurality of fingers is installed in a bank of adjacent channels such that the individual fingers are inserted into the ends of the respective adjacent channels to thereby present a restriction to the flow of refrigerant therein. As the refrigerant flows past the restrictions and into the unrestricted portion of the channels, expansion of the refrigerant occurs so as to thereby provide a homogeneous flow of refrigerant into the respective channels.

In accordance with another aspect of the invention, the body of the insert is supportably attached in an orthogonal relationship to a plate disposed within an inlet header and extending longitudinally therewith. The plate is secured in its installed position by brazing or the like.

By yet another aspect of the invention, the plate has a plurality of openings formed therein, between individual channels, so as to equalize the pressure on either side of the plate.

By still another aspect of the invention, the comb-like insert is fabricated by a stamping from a metal sheet with its fingers having increasing thickness and width as they approach the body portion of the insert.

In the drawings as hereinafter described, preferred and alternate embodiments are depicted; however, various other modifications and alternate designs and constructions can be made thereto without departing from the true spirit and scope of the invention.

DESCRIPTION OF THE PREFERRED EMBODIMENT

Figure 1:
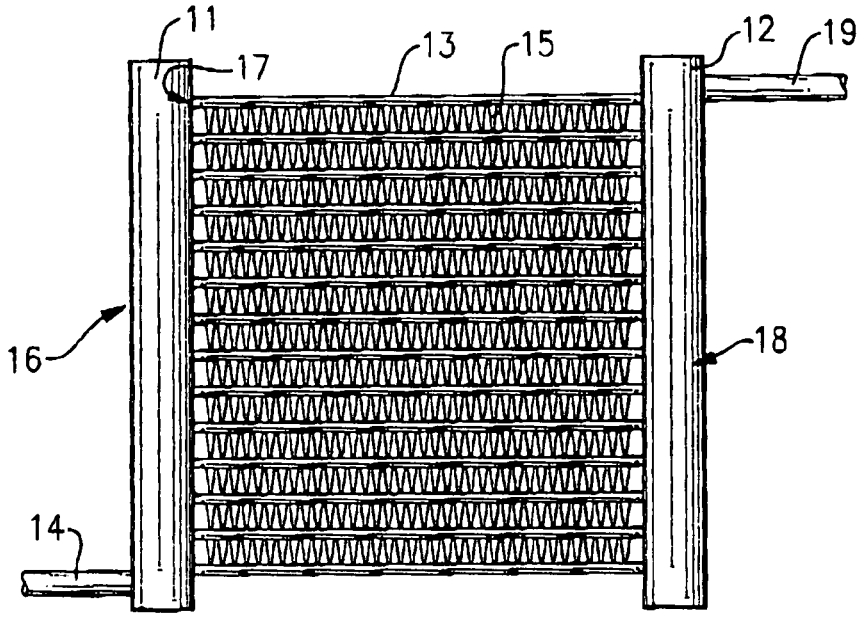
FIG.1 Prior Art
FIG. 1 is a schematic illustration of a parallel flow heat exchanger in accordance with the prior art.

Referring now to FIG. 1, a parallel flow heat exchanger is shown to include an inlet header or manifold 11, an outlet header or manifold 12 and a plurality of parallel channels 13 fluidly interconnecting the inlet manifold 11 to the outlet manifold 12. Generally, the inlet and outlet manifolds 11 and 12 are cylindrical in shape, and the channels 13 are usually tubes (or extrusions) of flattened shape. Channels 13 normally have a plurality of internal and external heat transfer enhancement elements, such as fins. For instance, external fins, disposed therebetween for the enhancement of the heat exchange process and structural rigidity are typically furnace-brazed. Channels 13 may have internal heat transfer enhancements and structural elements as well.

In operation, two-phase refrigerant flows into the inlet opening 14 and into the internal cavity 16 of the inlet header 11. From the internal cavity 16, the refrigerant, in the form of a liquid, a vapor or a mixture of liquid and vapor (the latter is a typical scenario) enters the channel openings 17 to pass through the channels 13 to the internal cavity 18 of the outlet header 12. From there, the refrigerant, which is now usually in the form of a vapor, passes out the outlet opening 19 and then to the compressor (not shown).

As discussed hereinabove, it is desirable that the two-phase refrigerant passing from the inlet header 11 to the individual channels 13 do so in a uniform manner (or in other words, with equal vapor quality) such that the full heat exchange benefit of the individual channels can be obtained and flooding conditions are not created and observed at the compressor suction (this may damage the compressor). However, because of various phenomena as discussed hereinabove, a non-uniform flow of refrigerant to the individual channels 13 (so-called maldistribution) occurs. In order to address this problem, the applicants have introduced design features that will create a restriction to the flow of refrigerant into the individual channels such that when the refrigerated flow exits the restrictions it will expand to provide a homogenous refrigerant mixture to the channels.

Figure 2:
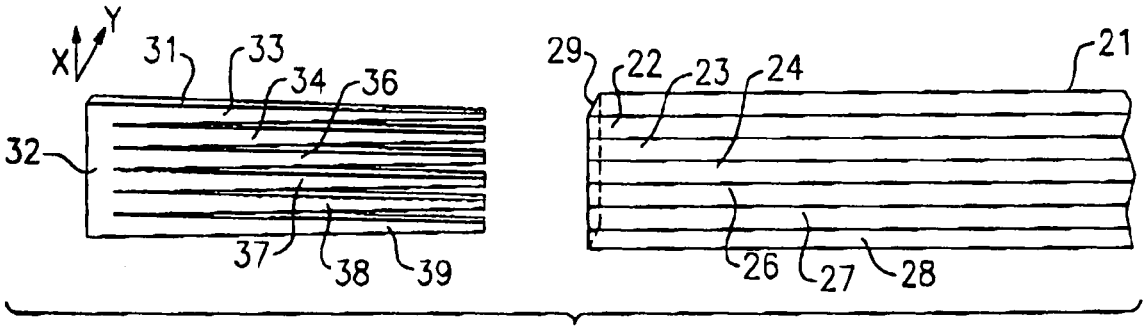
FIG. 2 is an exploded side view of a plurality of minichannels and an associated insert in accordance with the present invention.
Figure 3:
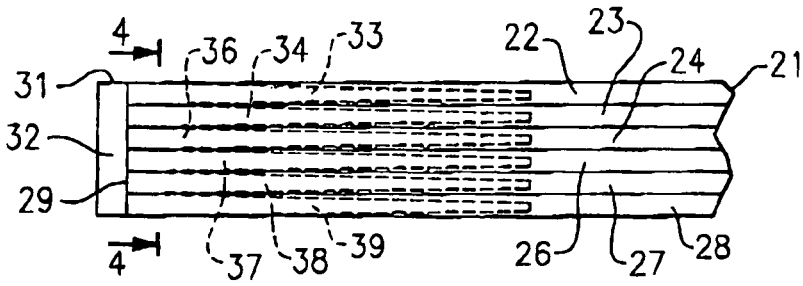
FIG. 3 is a side view thereof shown in the assembled condition.
Figure 4:
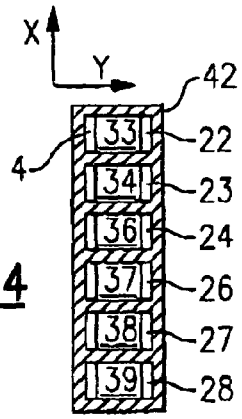
FIG. 4 is a sectional view thereof as seen along lines 4-4 in FIG. 3.

Referring now to FIGS. 2-4, a minichannel element is shown generally at 21 as including a plurality of parallel channels 22-28. As will be seen in FIG. 4, each of the minichannels is rectangular in cross-section and is fluidly connected to an inlet manifold and an outlet manifold (not shown). Without modification, these minichannels tend to receive an unequal distribution of the liquid and vapor refrigerant mixture such that the heat exchange performance efficiency thereof is reduced and flooding conditions at the compressor suction (potentially damaging to the compressor) are created. The present invention is designed to address this problem. It has to be understood that other cross-section configurations (such as triangular, trapezoidal, etc.) can equally benefit from the teachings of the invention.

An insert 31, having a body portion 32 and a plurality of teeth 33-39 extending therefrom in a comb-like fashion, is provided to restrict the flow of refrigerant into the inlet end 29 of the minichannel element 21. The insert 31 is preferably formed of a metal material such as aluminum and is fabricated by a process such as stamping from a metal sheet. The individual teeth 33-39 are preferably tapered, both in the width and thickness dimensions (i.e. X and Y planes) as they extend from the body 32 to the ends of the teeth. In this way, easy insertion of the individual teeth into their respective minichannels 22-28 is facilitated. Further, the flow of the refrigerant along the length of the individual teeth 33-39 is streamlined so as to improve the efficiency of the refrigerant flow pattern.

As is seen in FIG. 4, when the insert 31 is installed in its position within the minichannel element 21, the dimension of the teeth 33-39 and their corresponding minichannels 22-28 are such that in the X plane the two are in a relatively close fit relationship such that the insert is held in place by friction. In the Y plane, however, the thickness of the individual teeth at their widest thickness is substantially less then the internal dimensions of the minichannels, as shown, to thereby provide side openings 41 and 42 on either side of the teeth. These side openings 41 and 42 provide restricted space for the entry of refrigerant mixture into the individual channels. In this way, the flow is first restricted and than gradually becomes less restricted, so as to thereby allow the refrigerant mixture to expand as it flows along the individual teeth 33-39. Thus, the teeth 33-39 act as expansion devices in each of the respective minichannels 22-28 and thereby provide a more homogenous mixture of refrigerant into the minichannels. Obviously, X and Y planes are interchangeable in the sense that top and bottom (instead of side) restricted openings for the refrigerant entrance into each individual minichannel can be provided.

Figure 5:
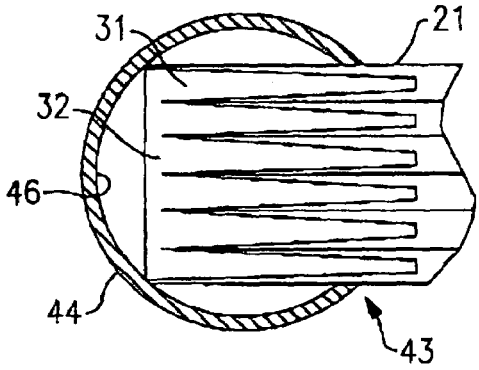
FIG. 5 shows a sectional view of the insert in a bank of minichannels installed in an inlet manifold.

Referring now to FIG. 5, there is shown a minichannel element 21 with its installed insert 31, with their assembly then being installed into an opening 43 of an inlet manifold 44. As is readily understood, it is important that the insert 31 remains in its fully installed position within the minichannel element 21 so as to maintain the predetermined size of the side openings 41 and 42. Accordingly, the minichannel element 21 is fully inserted into the inlet manifold opening 43 such that the body 32 of the insert 31 comes to rest against the back wall 46 of the inlet manifold 44 as shown. The minichannel element 21 is fixed in this position by brazing or the like at the interface between the inlet manifold opening 43 and the outer surface of the minichannel element 21.

Figure 6:
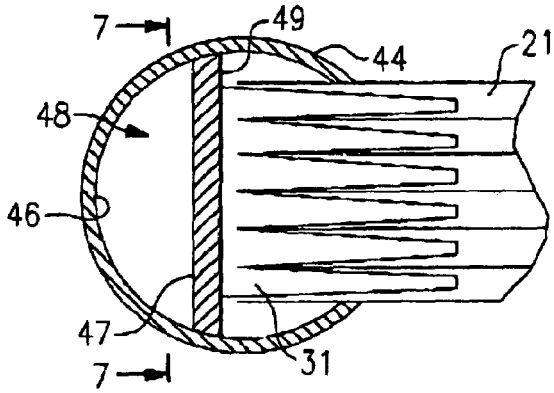
FIG. 6 is a sectional view of an alternative embodiment thereof that includes an installed plate within the inlet manifold.

An alternative approach is shown in FIG. 6 wherein, rather than relying on the back wall 46 of the inlet manifold 44 for supporting the assembly, a plate 47 is installed so as to extend longitudinally within the inner cavity 48 of the inlet manifold 44. The plate 47 is fixed within the inlet manifold 44 by brazing or the like. The assembly of the minichannel element 21 and the insert 31 is brought into engagement with the side 49 of the plate 47 as shown, with the minichannel element 21 than being fixed in place with respect to the inlet manifold 44 as described hereinabove.

Figure 7:
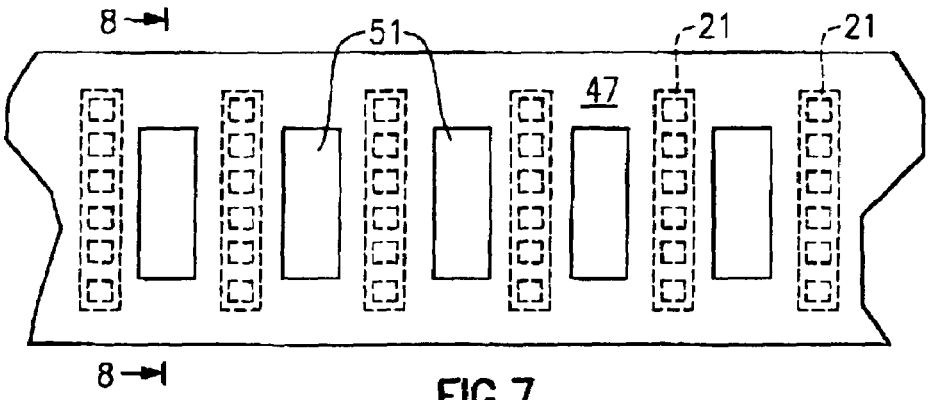
FIG. 7 is a rear view thereof as seen along lines 7-7 of FIG. 6 showing the plate with openings therein.
Figure 8:
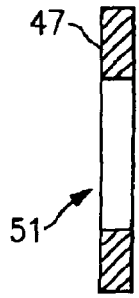
FIG. 8 is a section view as seen along lines 8-8 of FIG. 7.

The applicants have recognized that, as the refrigerant mixture flows into the inlet manifold 44, it will flow on both sides of the plate 47 and, unless accommodated, the pressure could vary substantially on either side of the plate 47. Thus, the plate 47 is preferably modified as shown in FIGS. 7 and 8 by providing a plurality of openings 51 in the plate 47 so as to equalize the pressure on the two sides of the plate 47 within the inlet manifold 44.

It should be noted that both vertical and horizontal channel orientations will benefit from the teaching of the present invention, although higher benefits will be obtained for the latter configuration.

While the present invention has been particularly shown and described with reference to preferred and alternate embodiments as illustrated in the drawings, it will be understood by one skilled in the art that various changes in detail may be effected therein without departing from the true spirit and scope of the invention as defined by the claims.

We claim:

1. An expansion device for a heat exchanger of the type having inlet and outlet manifolds fluidly interconnected by a plurality of parallel minichannels for conducting the flow of two-phase refrigerant therebetween, comprising:

a single insert having a plurality of fingers disposed in a multiplicity of said plurality of parallel minichannels said fingers being of smaller cross sectional area than their respective minichannels so as to first restrict flow of refrigerant into said multiplicity of channels and then gradually promote expansion thereof to thereby maintain a substantially uniform distribution of refrigerant to the channels.

2. An expansion device as set forth in claim 1, wherein said plurality of parallel minichannels have respective inlet ends that are fluidly connected to said inlet manifold and further wherein said single insert is disposed with its plurality of fingers into said inlet end openings.

3. An expansion device as set forth in claim 1, wherein said single insert includes a body that is integrally attached to said plurality of fingers.

4. An expansion device as set forth in claim 1, wherein said plurality of fingers are tapered so as to be of reduced cross-section area as they extend into said minichannels.

5. An expansion device as set forth in claim 1 and including means for retaining said insert in its installed position within said minichannels.

6. An expansion device as set forth in claim 5, wherein said retaining means comprises a frictional fit between said fingers and internal walls of their respective minichannels.

7. An expansion device as set forth in claim 5, wherein said retaining means include an internal surface within the inlet manifold that engages the insert to hold it in its installed position.

8. An expansion device as set forth in claim 7, wherein said internal structure comprises a plate that extends longitudinally within the inlet manifold with its one side abutting said insert.

9. An expansion device as set forth in claim 8, wherein said plate has a plurality of openings formed therein for equalizing the pressure on either side of the plate.

10. A method of promoting uniform two-phase refrigerant flow from an inlet manifold of a heat exchanger to a plurality of parallel minichannels fluidly connected thereto, comprising the steps of:

forming an insert that has a body and a plurality of fingers;

mounting said insert fingers in a multiplicity of said plurality of parallel minichannels; and causing refrigerant to pass around said insert fingers so as to be first restricted in flow and then gradually expanded as the refrigerant flows across less restricted portions of said fingers so as to thereby maintain a substantially uniform distribution of refrigerant flowing from the inlet manifold to the channels.

11. A method as set forth in claim 10, wherein said plurality of parallel minichannels have inlet ends fluidly connected to said inlet manifold and further wherein said insert is mounted with its plurality of fingers in respective inlet ends.

12. A method as set forth in claim 10, wherein said insert forming step includes the step of forming said plurality of fingers that are tapered along their length.

13. A method as set forth in claim 10, wherein said fingers are diminishing in cross-section as they extend into said plurality of minichannels.

14. A method as set forth in claim 10 and including the step of providing a means of retaining the insert in its installed position within said plurality of parallel minichannels.

15. A method as set forth in claim 14 and including the step of securing said insert in abutting relationship with an internal structure of said inlet manifold.

16. A method as set forth in claim 15, wherein said internal structure comprises a plate installed in the inlet manifold.

17. A method as set forth in claim 16, wherein said plate includes a plurality of openings formed therein to equalize the pressure on either side of said plate.

* * * * *